US007515120B2

(12) United States Patent
Choi

(10) Patent No.: US 7,515,120 B2
(45) Date of Patent: Apr. 7, 2009

(54) APPARATUS FOR REMOVING LOAD EFFECT IN PLASMA DISPLAY PANEL

(75) Inventor: Sang Dae Choi, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 735 days.

(21) Appl. No.: 11/034,711

(22) Filed: Jan. 14, 2005

(65) Prior Publication Data

US 2005/0156826 A1 Jul. 21, 2005

(30) Foreign Application Priority Data

Jan. 16, 2004 (KR) ..... 10-2004-0003225

(51) Int. Cl.
*G09G 3/28* (2006.01)

(52) U.S. Cl. ..... 345/68; 345/60

(58) Field of Classification Search ..... 345/60, 345/63, 68

See application file for complete search history.

(56) References Cited

U.S. PATENT DOCUMENTS

| | | | | |
|---|---|---|---|---|
| 6,100,859 | A | 8/2000 | Kuriyama et al. | |
| 7,173,580 | B2 * | 2/2007 | Weitbruch et al. | 345/60 |
| 2003/0179162 | A1 * | 9/2003 | Ooe et al. | 345/63 |

FOREIGN PATENT DOCUMENTS

| | | |
|---|---|---|
| CN | 1898716 | 12/2003 |
| JP | 09-034403 | 2/1997 |
| JP | 09-185343 | 7/1997 |
| WO | WO 2005/059879 | 6/2005 |

OTHER PUBLICATIONS

European Search Report dated May 29, 2006.
Chinese Office Action dated May 11, 2007.
Japanese Office Action dated Jun. 17, 2008.

* cited by examiner

*Primary Examiner*—Kevin M Nguyen
(74) *Attorney, Agent, or Firm*—KED & Associates, LLP

(57) ABSTRACT

The present invention relates to an apparatus for removing the load effect, and more particularly, to an apparatus for removing the load effect through addition or subtraction of the number of sustain pulses. The present invention includes an APL calculation unit for calculating an APL value by using gray scale information corresponding to an inputted frame, a pulse number calculation unit for determining the number of reference sustain pulses, which will be used in a current sub-field, based on the APL value from the APL calculation unit, a load calculation unit for calculating the ratio of cells that are selected to emit light based on the gray scale information, so as to calculate a load value in the current sub-field, and a compensation pulse number calculation unit for comparing a predetermined reference load with the load value outputted from the load calculation unit, controlling the number of the reference sustain pulses based on the comparison result, and then outputting the number of compensated sustain pulses. As such, the number of the sustain pulses is added or subtracted based on the comparison result between the load value of the current sub-field and the reference load. The present invention is advantageous in that it can save power consumption and reduce a screen flickering phenomenon.

13 Claims, 2 Drawing Sheets

APPARATUS FOR REMOVING LOAD EFFECT IN PLASMA DISPLAY PANEL

This Nonprovisional application claims priority under 35 U.S.C. § 119(a) on patent application Ser. No. 10-2004-0003225 filed in Korea on Jan. 16, 2004, the entire contents of which are hereby incorporated by reference.

BACKGROUND OF THE INVENTION

1. Field of the Invention

The present invention relates to an apparatus for removing the load effect, and more particularly, to an apparatus for removing the load effect through addition or subtraction of the number of sustain pulses.

2. Description of the Background Art

FIG. 1 is a view for explaining a method of representing the gray scale in a plasma display panel according to the prior art.

As shown in FIG. 1, the plasma display panel is driven with one frame being divided into several sub-fields SF1 to SF8 having a different number of emission in order to implement the gray scale of an image. Each of the sub-fields is divided into an address period where a discharge cell is selected, a sustain period where the gray scale is represented according to the number of sustain pulses, and the like.

The whole screen of the plasma display panel is composed of several cells. The ratio of cells, which are selected to emit light, among the cells is called a load. The higher the number of cells that are selected to emit light, the higher the load. Brightness is controlled by adjusting the number of sustain pulses. Although the number of sustain pulses is the same, brightness varies depending on a load because the amount of externally applied power is constant.

FIG. 2 is a graph illustrating variation in a brightness depending on a load in a given number of sustain pulses.

If the number of cells to be discharged increases and a load increases accordingly, more power is needed. Thus, there occurs a phenomenon that, assuming that the number of sustain pulses is the same, the higher the load, the lower the brightness. This is called the load effect.

Actually, if there is a desired brightness level in a given sub-field when a plasma display panel operates, the number of sustain pulses, which corresponds to the brightness level, is defined and then used to represent a brightness.

However, the brightness represented based on the number of sustain pulses, which is currently defined, varies according to the load, as shown in the graph of FIG. 2. This results in distortion of the gray scale. That is, if the number of sustain pulses is constant, brightness must be constant even when the load varies. However, since the brightness is changed according to the load, the picture quality is lowered. In the prior art, in order to prevent this load effect phenomenon, lowering in brightness depending on an increased load is compensated by increasing the number of sustain pulses as the load increases on the basis of a minimum value of the load.

However, if lowering in brightness depending on a load is compensated for through the conventional method, the total number of sustain pulses increases since a reference brightness level is based on a brightness when the load is the lowest. This results in increased power consumption. Furthermore, the brightness of the whole screen becomes brighter because of the increased number of the sustain pulses. Accordingly, there is a problem in that a flickering phenomenon of a screen becomes more severe.

SUMMARY OF THE INVENTION

The object of the present invention is to solve at least the problems and disadvantages of the background art.

According to an aspect of the present invention, there is provided an apparatus for removing a load effect in a plasma display panel, including an APL calculation unit for calculating an APL value by using gray scale information corresponding to an inputted frame, a pulse number calculation unit for determining the number of reference sustain pulses, which will be used in a current sub-field, based on the APL value from the APL calculation unit, a load calculation unit for calculating the ratio of cells that are selected to emit light based on the gray scale information, so as to calculate a load value in the current sub-field, and a compensation pulse number calculation unit for comparing a predetermined reference load with the load value outputted from the load calculation unit, controlling the number of the current subfield sustain pulses based on the comparison result, and then outputting the number of compensated sustain pulses.

The present invention is advantageous in that it can save power consumption and reduce a screen flickering phenomenon.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

According to an aspect of the present invention, there is provided an apparatus for removing a load effect in a plasma display panel, including an APL calculation unit for calculating an APL value by using gray scale information corresponding to an inputted frame, a pulse number calculation unit for determining the number of reference sustain pulses, which will be used in a current sub-field, based on the APL value from the APL calculation unit, a load calculation unit for calculating the ratio of cells that are selected to emit light based on the gray scale information, so as to calculate a load value in the current sub-field, and a compensation pulse number calculation unit for comparing a predetermined reference load with the load value outputted from the load calculation unit, controlling the number of the current subfield sustain pulses based on the comparison result, and then outputting the number of compensated sustain pulses.

The compensation pulse number calculation unit outputs the number of compensated sustain pulses, which is subtracted from the number of the current subfield sustain pulses, if the load value is smaller than the reference load.

The compensation pulse number calculation unit subtracts the number of compensated pulses, which corresponds to a difference between the load value and the reference load, from the number of the current subfield sustain pulses when the load value is smaller than the reference load, and then Outputs the subtraction result.

The compensation pulse number calculation unit sequentially selects and subtracts the number of compensated pulses, which is higher as the difference between the load value and the reference load becomes higher.

The compensation pulse number calculation unit outputs the number of compensated sustain pulses, which is more increased than the number of the current subfield sustain pulses, if the load value is greater than the reference load.

The compensation pulse number calculation unit adds the number of compensated pulses, which corresponds to a difference between the load value and the reference load, to the number of the current subfield sustain pulses when the load value is greater than the reference load, and then outputs the addition result.

The compensation pulse number calculation unit sequentially selects and subtracts the number of compensated pulses, which is higher as the difference between the load value and the reference load becomes higher.

Figure 3:
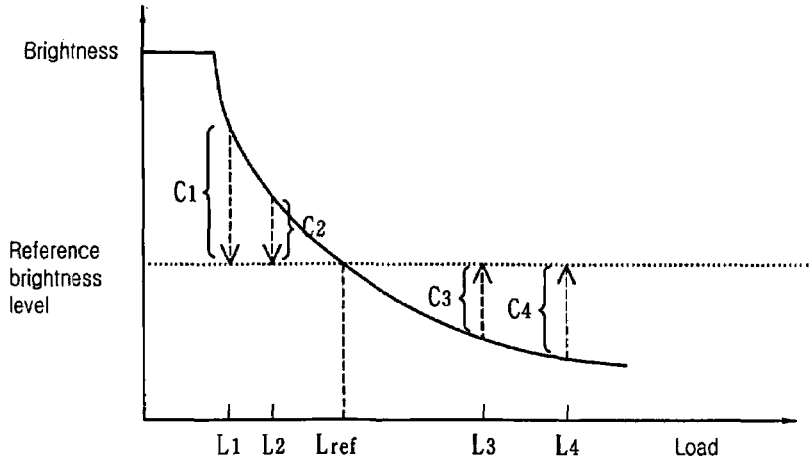
FIG. 3 is a graph shown to explain the concept of a method of removing the load effect according to the present invention.

FIG. 3 is a graph shown to explain the concept of a method of removing the load effect according to the present invention.

According to the method of removing the load effect in accordance with the present invention, if a given reference brightness level and the number of reference sustain pulses N in a given sub-field of a current frame are defined, the number of sustain pulses is subtracted from the number of the reference sustain pulses N in loads L1,L2, which are lower than a reference load Lref, and the number of sustain pulses in loads L3,L4, which are higher than the reference load Lref, is added to the number of the reference sustain pulses N, whereby a reference brightness level can be always outputted regardless of a load value. In this time, the number of reference sustain pulses refers to the number of sustain pulses, which are defined to be generated from a current sub-field.

Figure 1:
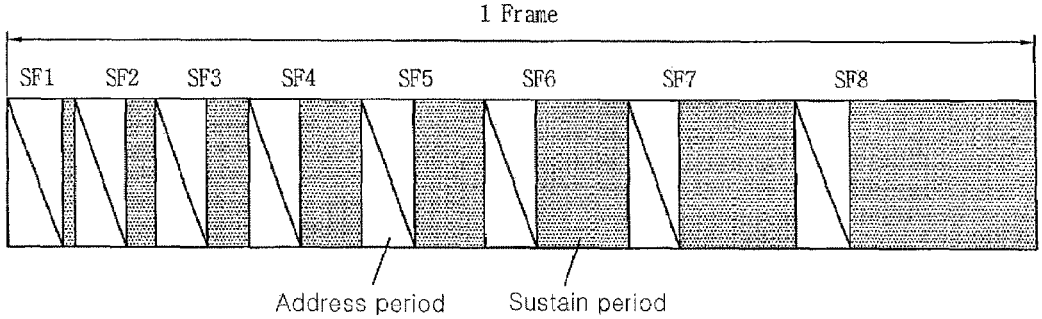
Fig. 1 Prior Art
FIG. 1 is a view for explaining a method of representing the gray scale in a plasma display panel according to the prior art.
Figure 2:
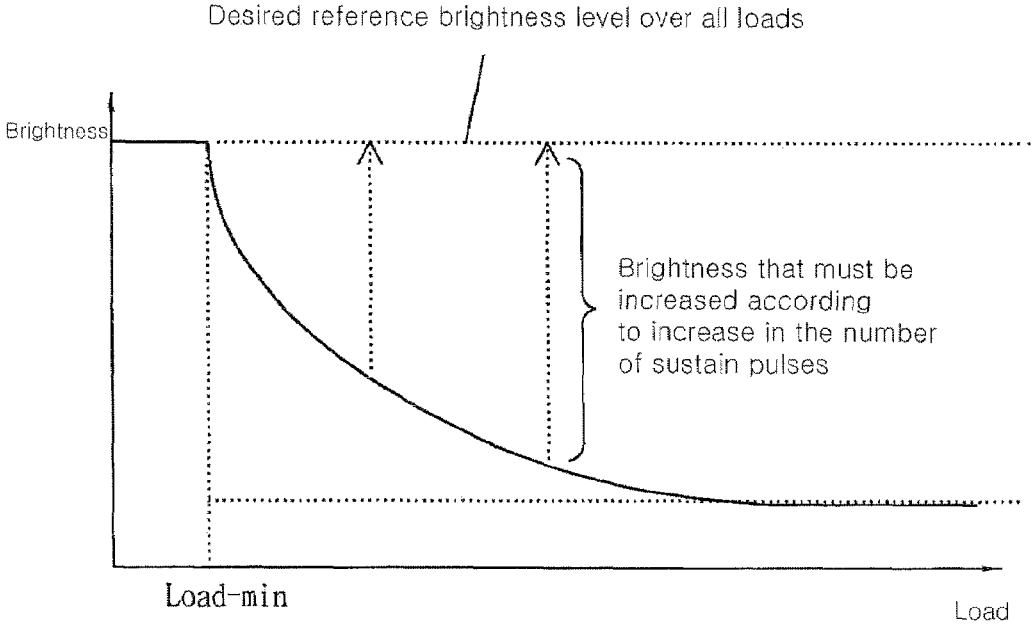
Fig. 2 Prior Art
FIG. 2 is a graph illustrating variation in a brightness depending on a load in a given number of sustain pulses.

That is, in the conventional method, the reference brightness level is set to brightness at a minimum load (Load_min) (see FIG. 2). Accordingly, there is a problem in that power consumption and flickering of a screen are increased since the number of sustain pulses is generally increased. In the present invention, however, the reference brightness level is set to brightness at a predetermined reference load Lref not the minimum load. In this state, in the loads L1,L2 lower than the reference load Lref, the number of reference sustain pulses is subtracted from the number of sustain pulses (N-C1, N-C2), and in the loads L3,L4 higher than the reference load Lref, the number of the reference sustain pulses is added to the number of sustain pulses (N+C3, N+C4). As such, the reference brightness level can be always maintained irrespective of the load.

Figure 4:
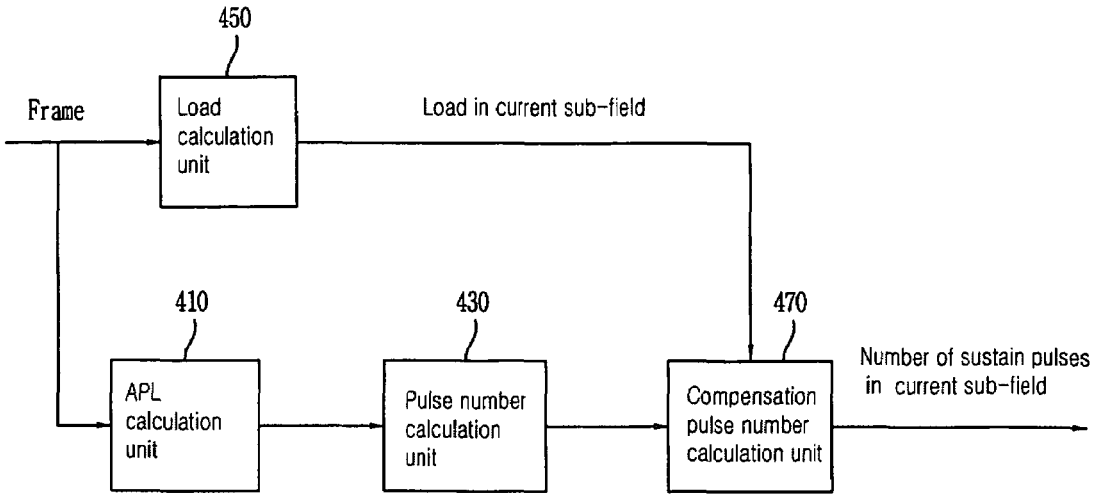
FIG. 4 is a block diagram illustrating the construction of an apparatus for removing the load effect according to the present invention.

FIG. 4 is a block diagram illustrating the construction of an apparatus for removing the load effect according to the present invention.

Referring to FIG. 4, the apparatus for removing the load effect according to the present invention includes an APL calculation unit 410, a pulse number calculation unit 430, a load calculation unit 450 and a compensation pulse number calculation unit 470.

<APL Calculation Unit>

The APL calculation unit 410 calculates an average picture level (APL) using gray scale information corresponding to an inputted frame.

<Pulse Number Calculation Unit>

The pulse number calculation unit 430 determines the number of reference sustain pulses N, which will be used in a current sub-field, based on the APL value from the APL calculation unit 410.

<Load Calculation Unit>

The load calculation unit 450 calculates the ratio of cells, which are selected to emit light, by using gray scale information corresponding to an inputted frame, so s to calculate a load value in a current sub-field.

<Compensated Pulse Number Calculation Unit>

The compensation pulse number calculation unit 470 compares a predetermined reference load Lref and the load value at the current sub-field, which is calculated by the load calculation unit 450, adds the number of compensated pulses to the number of the reference sustain pulses N if the load value at the current sub-field is higher than the reference load Lref, and subtracts the number of compensated pulses from the number of the reference sustain pulses N if the load value at the current sub-field is lower than the reference load Lref, thereby outputting the number of compensated sustain pulses at the current sub-field.

The operation of the apparatus for removing the load effect according to the present invention will now be described in detail with reference to FIGS. 3 and 4.

It is assumed that load values in individual sub-fields, which are calculated in the load calculation unit 450, are L1, L2, L3 and L4, the amount of the load values is L1<L2<L3<L4, and the number of compensated pulses, which are respectively applied to these load values by the compensation pulse number calculation unit 470, is C1, C2, C3 and C4.

The APL calculation unit 410 outputs an APL value, which is calculated using gray scale information corresponding to an inputted frame, to the pulse number calculation unit 430. The pulse number calculation unit 430 determines the number of reference sustain pulses N, which will be used in a current sub-field, based on the APL value.

If a load value of a current sub-field is L1, the compensation pulse number calculation unit 470 compares the load value L1 and the predetermined reference load Lref. Since L1 is lower than the reference load Lref, the compensation pulse number calculation unit 470 selects the number of compensated pulses C1 based on the difference between the load value L1 and the reference load Lref, and subtracts the number of the compensated pulses C1 from the number of the reference sustain pulses N. In this time, the reference load Lref indicates a given load value, which becomes a reference brightness level.

As such, if a load value in a current sub-field is higher than the reference load Lref, the compensation pulse number calculation unit 470 maintains a reference brightness level by subtracting the number of sustain pulses. In the same manner, if the load value in the current sub-field is L2, the compensation pulse number calculation unit 470 maintains a reference brightness level by subtracting the number of sustain pulses.

If a load value in a current sub-field is L3, the compensation pulse number calculation unit 470 compares the load value L3 and the predetermined reference load Lref. Since L3 is higher than the reference load Lref, the compensation pulse number calculation unit 470 selects the number of compensated pulses C3 based on the difference between the load value L3 and the reference load Lref, and adds the number of the compensated pulses C3 to the number of the reference sustain pulses N.

As such, if the load value in the current sub-field is lower than the reference load Lref, the compensation pulse number calculation unit 470 maintains a reference brightness level by adding the number of sustain pulses. In the same manner, if the load value in the current sub-field is L4, the compensation pulse number calculation unit 470 maintains a reference brightness level by adding the number of sustain pulses.

As described above, according to the present invention, the number of sustain pulses is added or subtracted by comparing a load value of a current sub-field and a reference load. Accordingly, the present invention is advantageous in that it can save power consumption and reduce a screen flickering phenomenon.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An apparatus for removing a load effect in a plasma display panel, comprising:

an average picture level (APL) calculation unit for calculating an average picture level (APL) value by using gray scale information corresponding to an inputted frame;

a pulse number calculation unit for determining a number of reference sustain pulses that will be used in a current sub-field, based on the average picture level (APL) value from the average picture level (APL) calculation unit;

a load calculation unit for calculating a ratio of cells that are selected to emit light based on the gray scale information, so as to calculate a load value in the current sub-field; and a compensation pulse number calculation unit for comparing a predetermined reference load with the load value outputted from the load calculation unit, and then outputting a number of compensated sustain pulses which is subtracted from or added to the number of sustain pulses for the current subfield based on a result of the comparison.

2. The apparatus as claimed in claim 1, wherein the compensation pulse number calculation unit outputs the number of compensated sustain pulses, which is subtracted from the number of the sustain pulses for the current subfield, if the load value is smaller than the reference load.

3. The apparatus as claimed in claim 2, wherein the compensation pulse number calculation unit subtracts the number of compensated sustain pulses, which corresponds to a difference between the load value and the reference load, from the number of the sustain pulses for the current subfield when the load value is smaller than the reference load, and the compensation pulse number calculation unit outputs the result of the subtraction.

4. The apparatus as claimed in claim 3, wherein the compensation pulse number calculation unit sequentially selects and subtracts the number of compensated sustain pulses, which becomes higher as the difference between the load value and the reference load becomes higher.

5. The apparatus as claimed in claim 1, wherein the compensation pulse number calculation unit outputs the number of compensated sustain pulses, which is added to the number of the current subfield sustain pulses, if the load value is greater than the reference load.

6. The apparatus as claimed in claim 5, wherein the compensation pulse number calculation unit adds the number of compensated sustain pulses, which corresponds to a difference between the load value and the reference load, to the number of the sustain pulses for the current subfield when the load value is greater than the reference load, and the compensation pulse number calculation unit outputs the result of the addition.

7. The apparatus as claimed in claim 6, wherein the compensation pulse number calculation unit sequentially selects and adds the number of compensated sustain pulses, which becomes higher as the difference between the load value and the reference load becomes higher.

8. A plasma display apparatus comprising:

an average picture level (APL) unit to determine an average picture level (APL) value based on gray scale information of a frame;

a pulse number calculation unit to determine a number of sustain pulses in a current sub-field based on the determined average picture level (APL) value;

a load calculation unit to determine a load value of the current sub-field; and a compensation pulse number unit to provide a number of compensated sustain pulses, the number of compensated sustain pulses being subtracted from the number of sustain pulses for the current subfield when the load value is less than a predetermined reference load value.

9. The plasma display apparatus as claimed in claim 8, wherein the compensation pulse number unit to output a result of the subtraction.

10. The plasma display apparatus as claimed in claim 8, wherein the load calculation unit to determine the load value by calculating a ratio of cells that are selected to emit light based on the gray scale information.

11. The plasma display apparatus as claimed in claim 10, wherein the compensation pulse number unit to output a result of the addition.

12. A plasma display apparatus comprising:

an average picture level (APL) unit to determine an average picture level (APL) value based on gray scale information of a frame;

a pulse number calculation unit to determine a number of sustain pulses in a current sub-field based on the determined average picture level (APL) value;

a load calculation unit to determine a load value of the current sub-field; and a compensation pulse number unit to provide a number of compensated sustain pulses, the number of compensated sustain pulses being added to the number of sustain pulses for the current subfield when the load value is greater than a predetermined reference load value.

13. The plasma display apparatus as claimed in claim 12, wherein the load calculation unit to determine the load value by calculating a ratio of cells that are selected to emit light based on the gray scale information.

* * * * *